US008763812B2

(12) United States Patent
Enfantino

(10) Patent No.: US 8,763,812 B2
(45) Date of Patent: Jul. 1, 2014

(54) PARTICLE CLASSIFIER APPARATUS

(76) Inventor: Richard L Enfantino, San Jose, CA (US)

( * ) Notice: Subject to any disclaimer, the term of this patent is extended or adjusted under 35 U.S.C. 154(b) by 146 days.

(21) Appl. No.: 13/420,873

(22) Filed: Mar. 15, 2012

(65) Prior Publication Data

US 2013/0001138 A1 Jan. 3, 2013

Related U.S. Application Data

(60) Provisional application No. 61/503,805, filed on Jul. 1, 2011.

(51) Int. Cl.
*B07B 9/00* (2006.01)
*B03B 5/26* (2006.01)

(52) U.S. Cl.
CPC ..... *B03B 5/26* (2013.01)
USPC ..... 209/18

(58) Field of Classification Search
USPC ..... 209/18, 44, 268, 458, 506, 906, 44.2
See application file for complete search history.

(56) References Cited

U.S. PATENT DOCUMENTS

| | | | | | |
|---|---|---|---|---|---|
| 743,413 | A * | 11/1903 | Allen | 209/43 |
| 2,075,747 | A * | 3/1937 | Nolte | 209/44 |
| 3,575,293 | A * | 4/1971 | Nelson | 209/458 |
| 4,312,749 | A * | 1/1982 | Bingham | 209/44 |
| 5,287,975 | A * | 2/1994 | Chumley et al. | 209/3 |
| 7,438,188 | B2 * | 10/2008 | Stolworthy | 209/44 |
| 2010/0193406 | A1 * | 8/2010 | Alderson et al. | 209/44 |

* cited by examiner

*Primary Examiner* — Thomas Morrison

(57) ABSTRACT

A particle classifier apparatus used to mine for gold and other precious particles. The present invention is meant to replace the sluice box or any inefficient means for gold mining. The present invention is used with and without a stream of flowing water. The present invention comprises a PVC channel, a main trough and a plurality of small troughs. The PVC channel comprises a slit with a narrow end and a wide end. The present invention is designed for the stream of flowing water to flow from the narrow end to the wide end. The water flow pushes the particles through the slit and into the plurality of troughs located beneath the slit. The smallest particles fall into the narrow end whereas the big particles fall into the wide end. The plurality of small troughs are removed from the main trough so the captured particles may be panned for gold.

17 Claims, 21 Drawing Sheets

PARTICLE CLASSIFIER APPARATUS

The current application claims a priority to the U.S. Provisional Patent application Ser. No. 61/503,805 filed on Jul. 1, 2011.

FIELD OF THE INVENTION

The present invention relates generally to a particle classifier apparatus used to mine gold. The preferred embodiment of the present invention is intended for but not limited to gold. The present invention intends to improve the efficacy of the separating process utilized in placer mining to separate heavy precious metals from lighter gauge. In placer mining, sand and sediment are collected from a bed stream and processed through classifying instruments such as sluice box, plastic bucket classifier, wire mesh or any classifier that separates small rocks from big rocks. The common classifier in the field is the sluice box, which is placed in a stream bed to allow stream sediment to settle in. The present invention functions like the sluice box, but unlike the sluice box, the present invention does not need to be removed from the stream bed to be cleaned and inspected for entrapped precious particles. The collected precious metals in a plurality of small troughs may be inspected at any time during the mining processing. The present invention comprises a plurality of riffles, a slit and a plurality of small troughs. Similar to the sluice box, the plurality of riffles of the particle classifier apparatus serves to entrap the heavy precious metals in the sediment. The plurality of riffles then conduct the heavy precious metals down to the slit and consequently the plurality of small troughs located beneath the slit. The plurality of small troughs may be accessed at any time by the user during the process. The particle classifier is operated along with a flow of stream water, which deposits particles and sediment into the slit and the plurality of small troughs. The claimed particle classifier may be operated along with a flow of water from any source other than streams.

BACKGROUND OF THE INVENTION

The present invention is a particle classifier apparatus used to mine gold or other precious particles. The dimensions as described in the following are not intended to limit the scope of the invention. The present invention eliminates the screening of particles with a wire mesh, grizzly bars, plastic bucket classifiers or anything that separates small rocks from big rocks. It classifies the particles into multiple different size compartments which in turn can be removed and be panned separately in a regular gold pan. Thus, the present invention eliminates all the classifying with a wire mesh and a sluice box, an inefficient process during which the bigger rocks are picked out and the smaller rocks still need further classification. Unlike a sluice box, the particle classifier apparatus does not have to be removed from the water to be cleaned out or be taken apart to get to the compartments of panned particles. Any one of a plurality of small troughs can be checked at anytime without having to clean out the entire apparatus. The present invention classifies with the flow of water, allowing the particles fall through a slit, into the plurality of small troughs, ready to be panned for gold. The present invention is easy to use, light and portable. The present invention can also be used if there is no flowing water. To achieve this, the particles are flushed down with a bucket of water at the top of the present invention while the present invention is tilted at a steep angle.

DETAILED DESCRIPTION OF THE INVENTION

All illustrations of the drawings are for the purpose of describing selected versions of the present invention and are not intended to limit the scope of the present invention.

Figure 13:
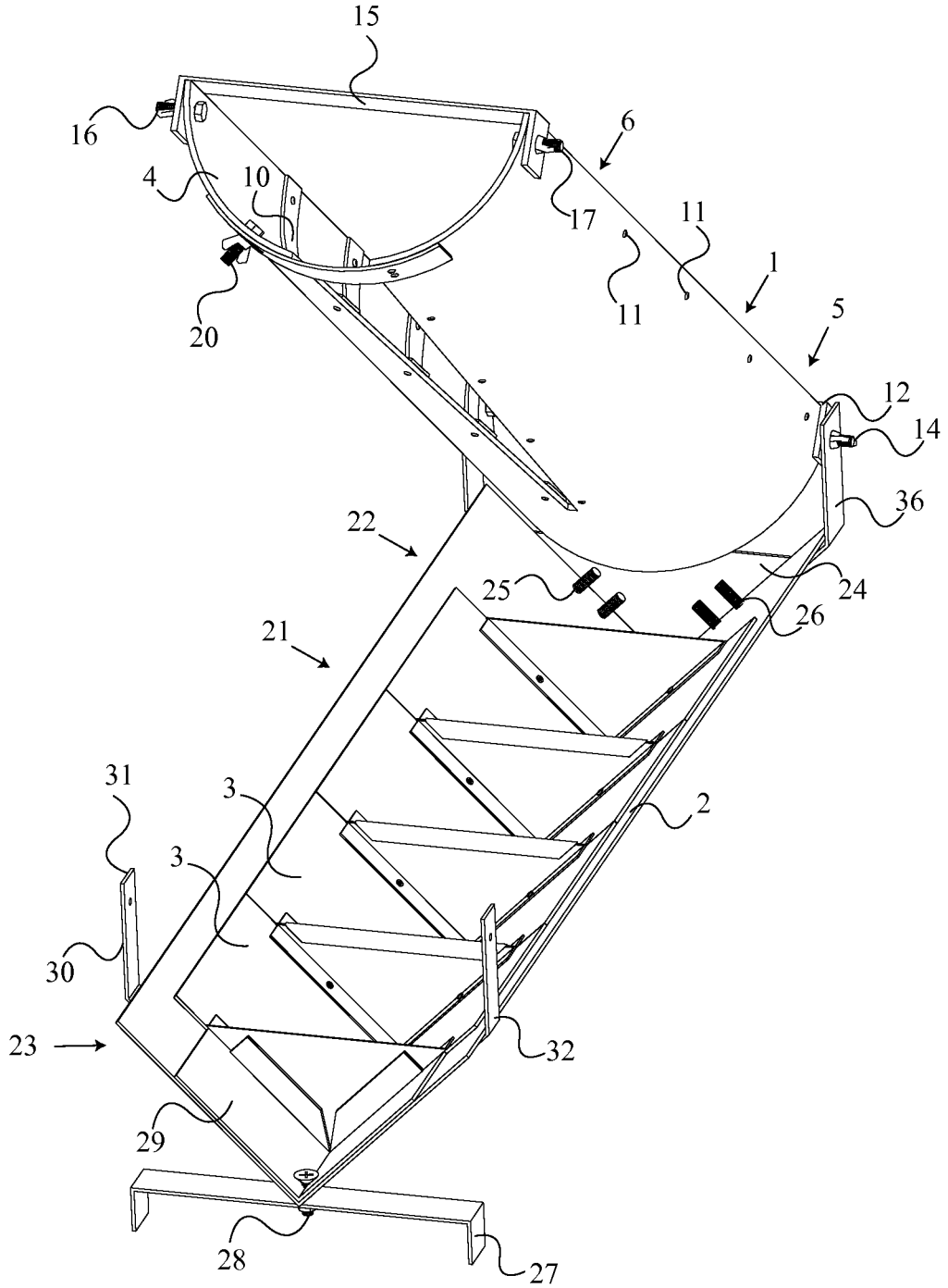
FIG. 13 is a right perspective view of the present invention when the invention is open.
Figure 14:
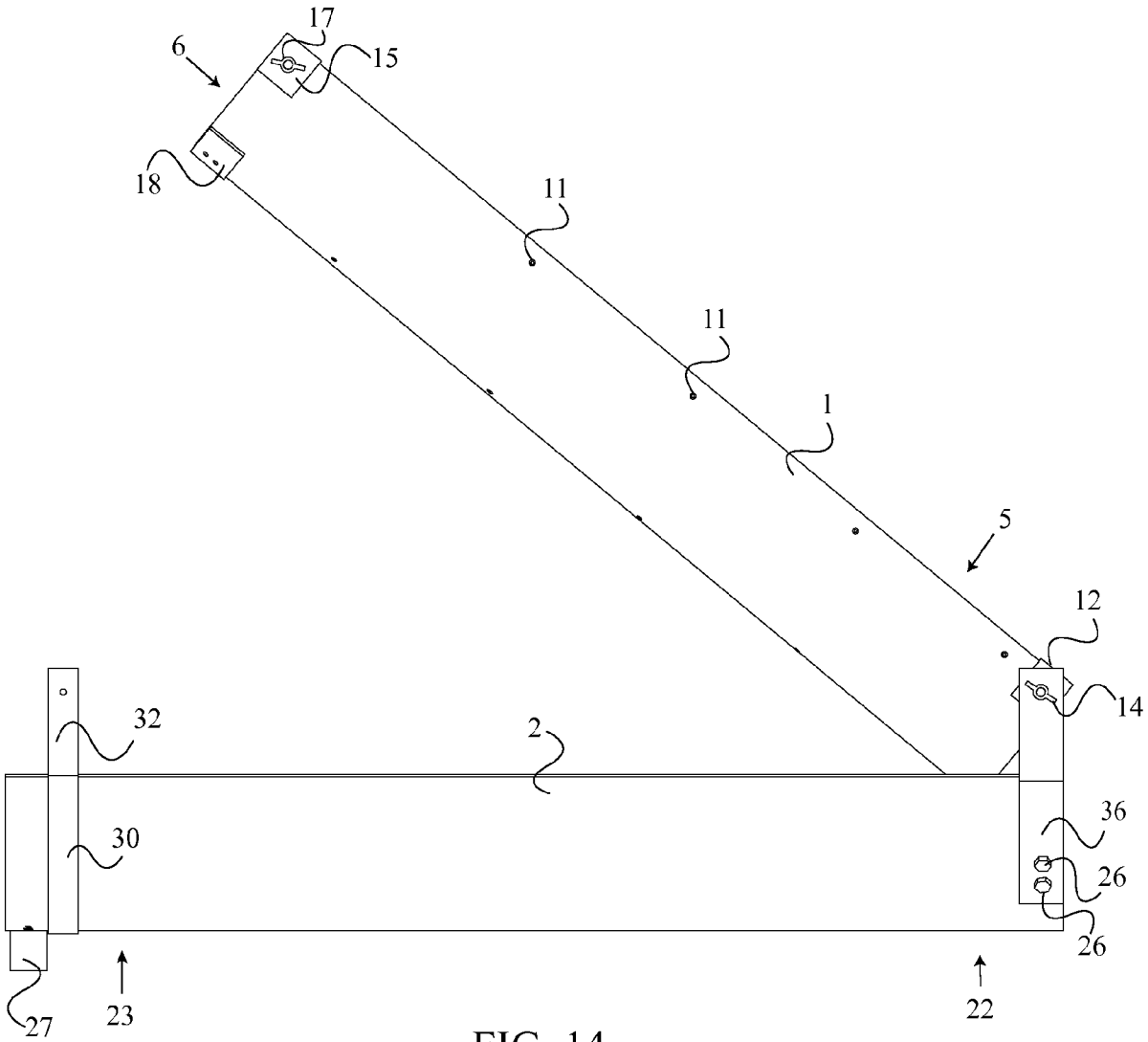
FIG. 14 is a right view of the present invention when the invention is open.
Figure 15:
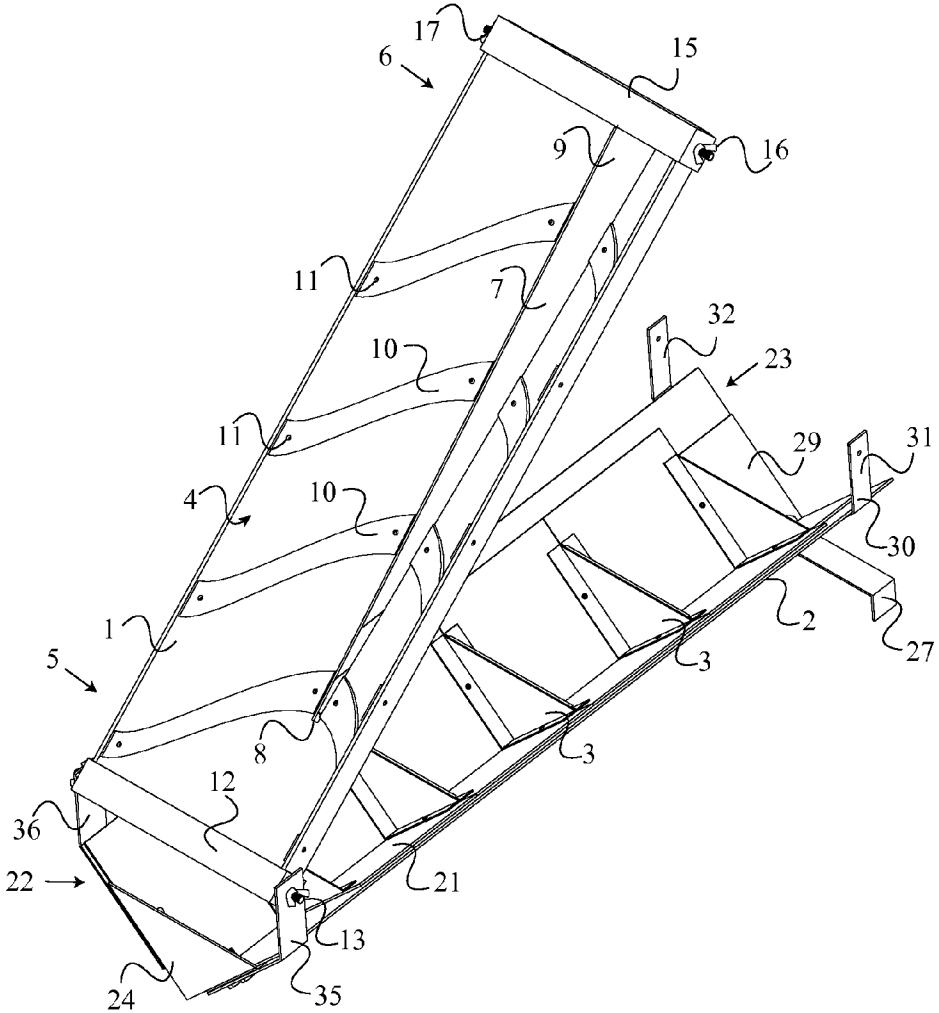
FIG. 15 is a top right perspective view of the present invention when the invention is open.
Figure 16:
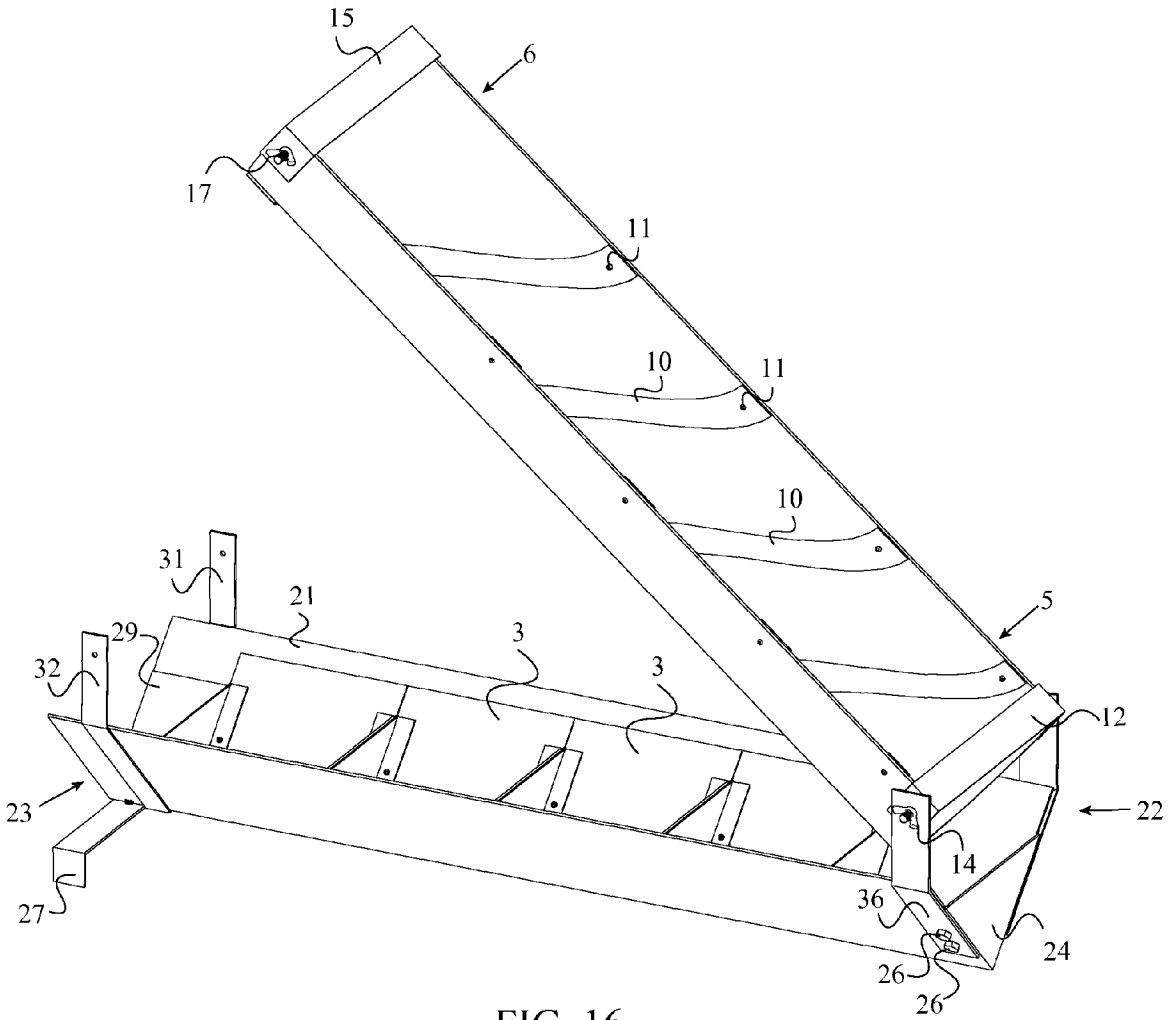
FIG. 16 is a top left perspective view of the present invention when the invention is open.
Figure 17:
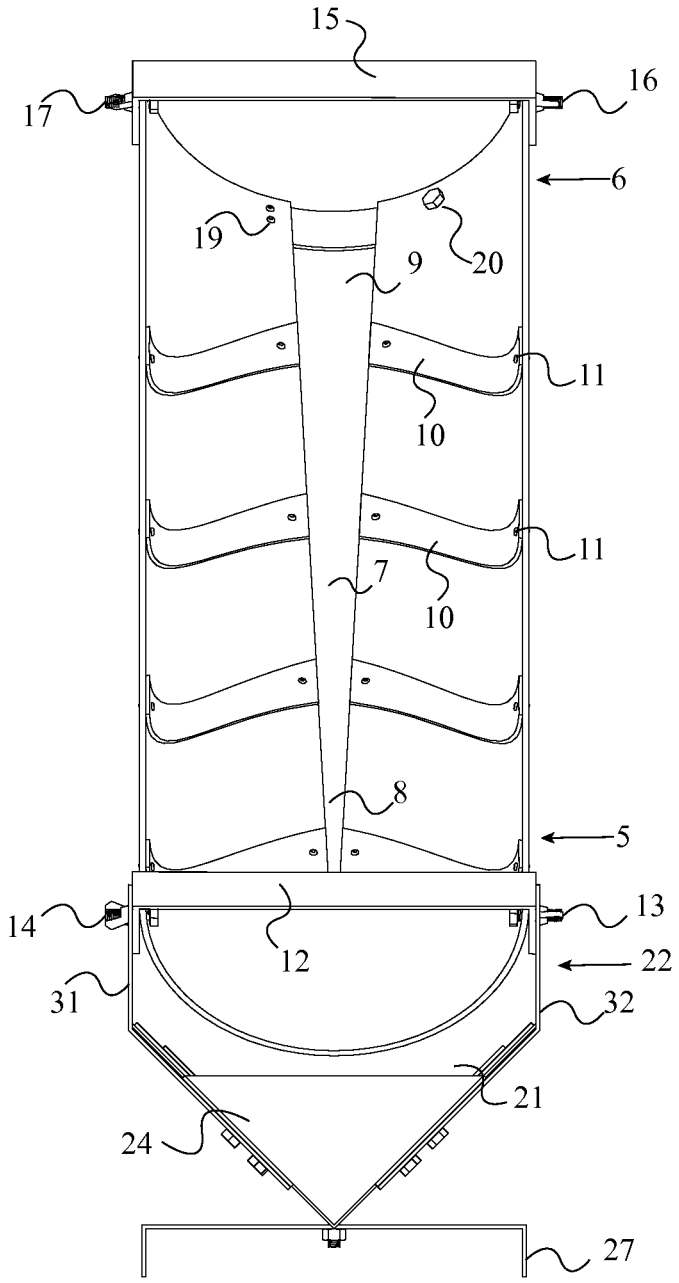
FIG. 17 is a top perspective view of the present invention when the invention is open.

As can be seen FIG. 13 and FIG. 15, a plurality of small troughs 3 is situated on a trough inside 21, which is the inside of a main trough 2. The main trough 2 is made of aluminum or any malleable material. In the preferred embodiment, the main trough 2 is 36 inches in length, 6 inches in height, and 6 inches in width. Additionally, the cross section of the main trough 2 is a 90-degree V-shape. It is understood that the cross section of the main trough 2 in the present invention is not limited to a 90-degree V-shape. The cross section of the main trough 2 can be of any shape. Situated on top of both the plurality of small troughs 3 and the main trough 2 is a Polyvinyl Chloride (PVC) channel. The PVC channel 1 is a vertical half of a PVC pipe. It is understood that in the present invention, the PVC channel 1 is not strictly composed of PVC. The PVC channel 1 may be composed of any material, in any shape or configuration. In the preferred embodiment, the PVC channel 1 is also 36 inches in length and 6 inches in diameter. A top PVC end 5 is fastened to a top trough end 22 by a top bracket 12, a top left fastener 13, a top right fastener 14, a top left connector 35 and a top right connector 36. The top left connector 35 and the top right connector 36 are two separate L-shaped connector pieces that connect the top PVC end 5 to the top trough end 22. Furthermore, the top left connector 35 and the top right connector 36 help stabilize the top end of the present invention. The top left connector 35 and the top right connector 36 each comprises a hole, wherein the top left fastener 13 and the top right fastener 14 are to be attached to. Located at the bottom of each L of the top left connector 35 and the top right connector 36 is a plurality of holes for bolts to connect the top left connector 35 and the top right connector 36 to the main trough 2. The top left connector 35 and the top right connector 36 are attached the top PVC end 5 along with the top bracket 12 to the top trough end 22.

The top PVC end 5 is rotatably attached to the top trough end 22. A bottom PVC end 6 is fastened to a bottom trough end 23 by a bottom bracket 15, a trough connector 30, a bottom left fastener 16, and a bottom right fastener 17. The trough connector 30 comprises a left trough connector 31 and a right trough connector 32. The trough connector 30 serves as a carrying strap to fasten the PVC channel 1 to the main trough 2. The trough connector 30 is also utilized to hold the present invention together when the user needs to transport the particle classifier apparatus from one location to another. The left trough connector 31 fastens a left side of the bottom PVC end 6 to a left side of the bottom trough end 23 via the bottom left fastener 16. The right trough connector 32 fastens a right side of the bottom PVC end 6 to a right side of the bottom trough end 23 via the bottom right fastener 17. The trough connector 30 can be easily detached from the bottom left fastener 16 and the bottom right fastener 17, respectively, to unfasten the bottom PVC end 6 from the bottom trough end 23. Once the bottom PVC end 6 is unfastened from the bottom trough end 23, the bottom bracket 15 is still attached to the bottom PVC end 6. Therefore, the bottom PVC end 6 can be lifted by the user via the bottom bracket 15 to upend the PVC channel 1, so the plurality of small troughs 3 can be removed once the plurality of small troughs 3 is full. With the aforementioned components attached, both the top bracket 12 and the bottom bracket 15 may serve as handles for the user to easily carry and lift the present invention from one location to another.

Figure 20:
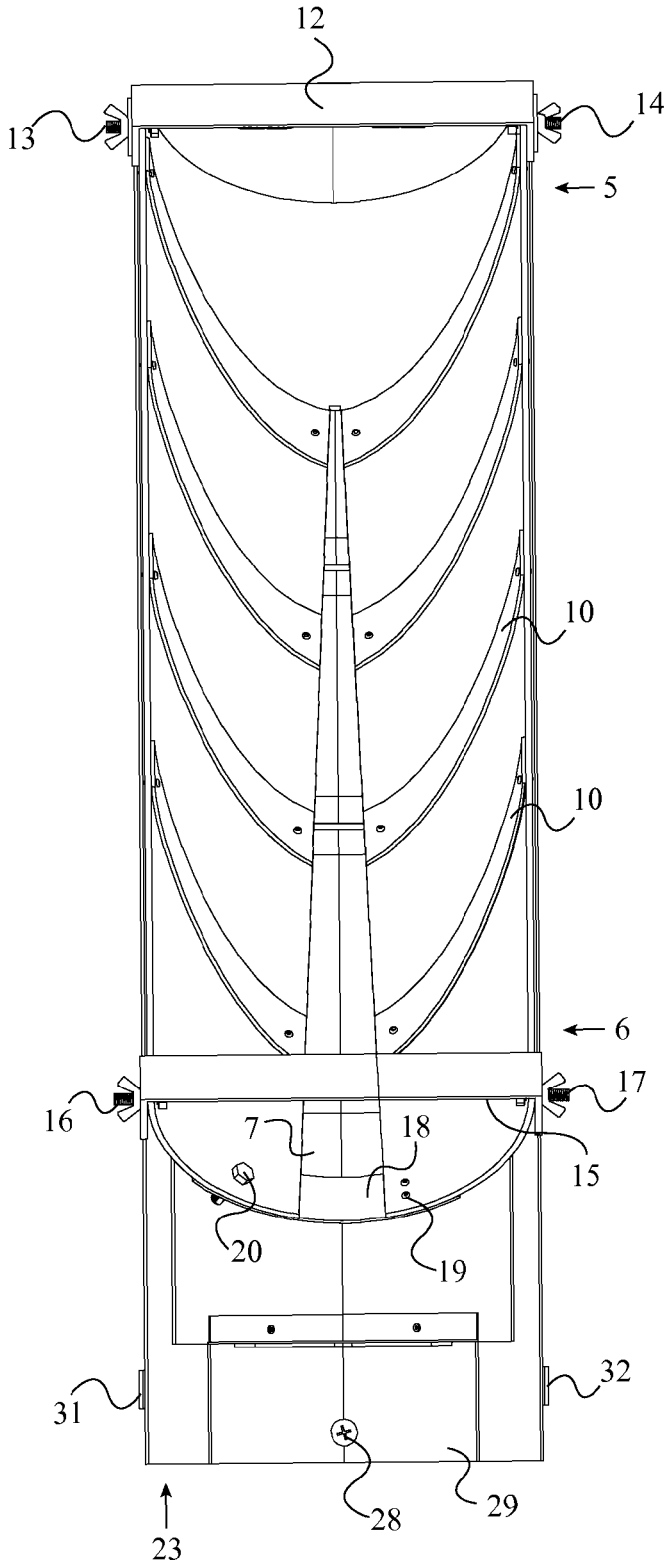
FIG. 20 is a top perspective view of the present invention when the invention is open.
Figure 21:
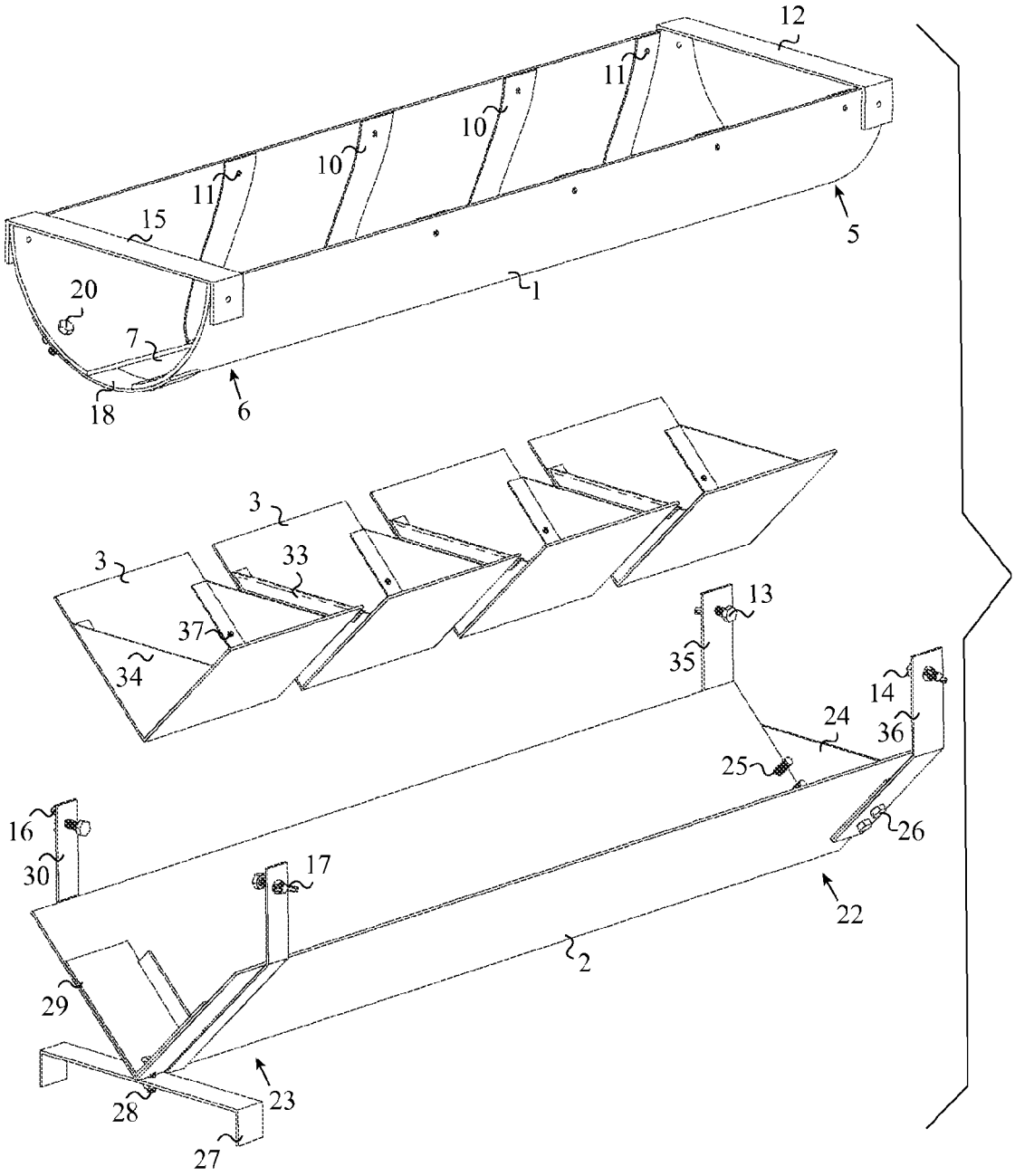
FIG. 21 is an exploded view of the present invention.

As can be seen in FIG. 15 and FIG. 20, the particles reach the plurality of small troughs 3 via a slit 7 located in the middle and along a PVC inside 4. The slit 7 is a long triangular slit with a narrow end 8 and a wide end 9. It is understood that the narrow end 8 and the wide end 9 of the slit 7 can be of any dimensions other than those specified in the preferred embodiment. In the preferred embodiment, the length of the slit 7 is 26 inches while the narrow end 8 is 1/16 of an inch and the wide end 9 is ¾ of an inch. The difference in width of the slit 7 allows the present invention to classify particles by size. The narrow end 8 is adequately narrow to allow passage of particles or denser constituents of sand and sediment therethrough. The narrow end 8 is positioned near the top PVC end 5, whereas the wide end 9 is positioned at the bottom PVC end 6. Between the narrow end 8 of the slit 7 and the top PVC end 5 is a distance of 10 inches, which is the difference between the length of the slit 7 and the length of the PVC channel 1. The wide end 9 of the slit 7 is essentially a gap and has a slit connector 18 fastened to one end by a plurality of connector flat bolts 19 and the other end by a connector fastener 20. The attachment of the slit connector 18 to the wide end 9 of the slit 7 keeps the PVC channel 1 stable and prevents the PVC channel 1 from splitting vertically into two halves. Additionally, the slit connector 18 allows the width of the wide end 9 to be adjustable to accommodate various sizes of large particles passing into the wide end 9.

As can be seen in FIG. 15, a plurality of curved bars 10 situates on each lateral side of the slit 7. The plurality of curved bars 10 is fastened to the PVC inside 4 by a plurality of flat bolts 11. The plurality of curved bars 10 serves as riffles or barriers to entrap the heavier, precious metals and conduct the said precious metals into the slit 7. It is understood that the plurality of curved bars 10 may be riffles of any configuration other than the plurality of curved bars 10 mentioned in the preferred embodiment. The plurality of curved bars 10 is separated from each other by a constant pitch on each lateral side of the slit 7. The constant pitch between each of the plurality of curved bars allows particles of different weights to accumulate along the slit 7. The plurality of curved bars 10 on one side of the slit 7 corresponds to the plurality of curved bars 10 on the other side of the slit 7 in such a manner wherein the plurality of curved bars 10 on one side of the slit 7 minors the plurality of curved bars 10 on the other side of the slit 7. The plurality of curved bars 10 on both lateral sides of the slit 7 serves as conduits for the particles to pass into the slit 7 with the smallest and densest particles passing into the narrow end 8 and the largest particles or lighter gangue passing into the wide end 9. The particles are caught by the plurality of small troughs 3 located beneath the slit 7, below the PVC channel 1.

Figure 1:
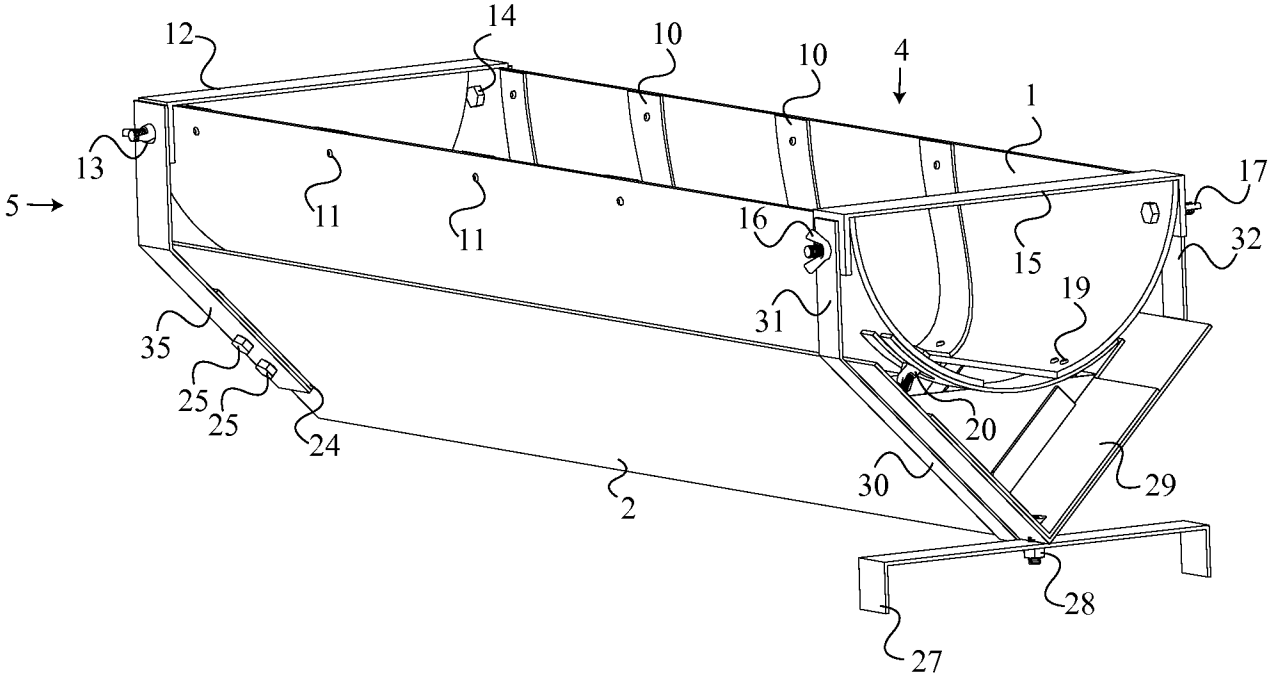
FIG. 1 is a left perspective view of the present invention when the invention is closed.
Figure 2:
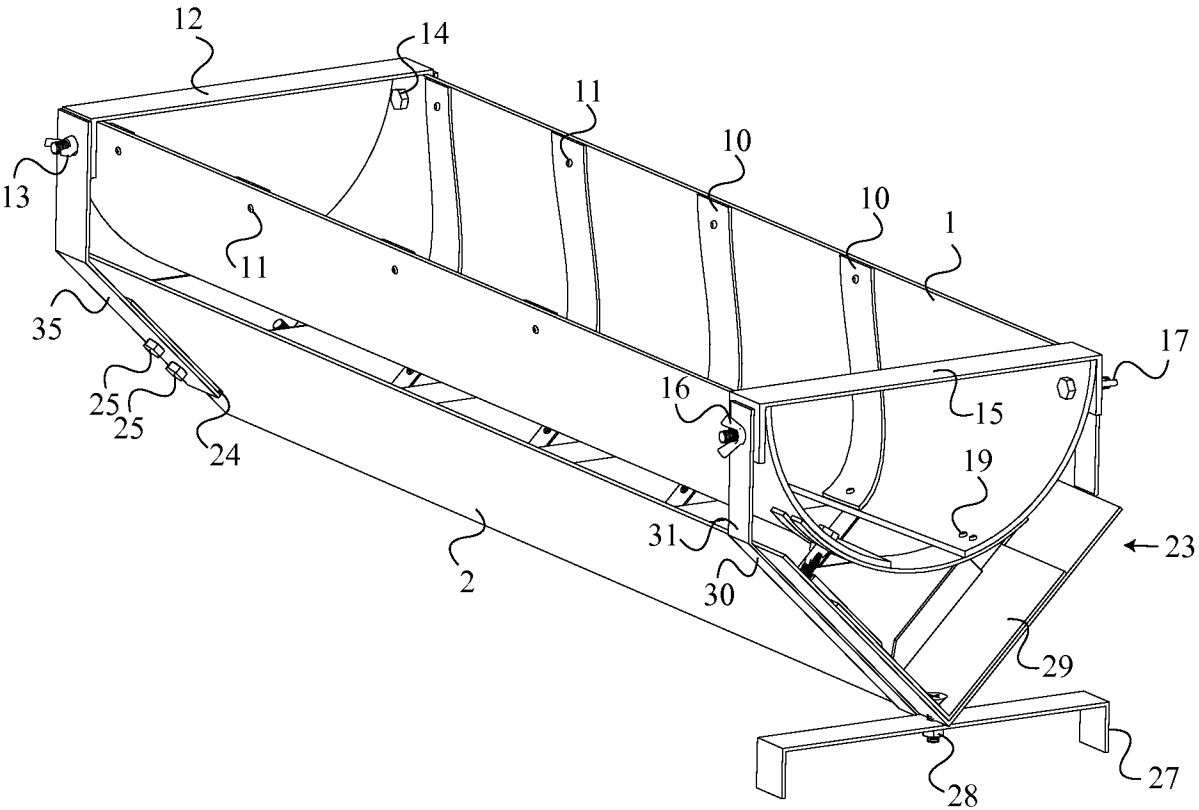
FIG. 2 is a left perspective view of the present invention when the invention is closed.
Figure 3:
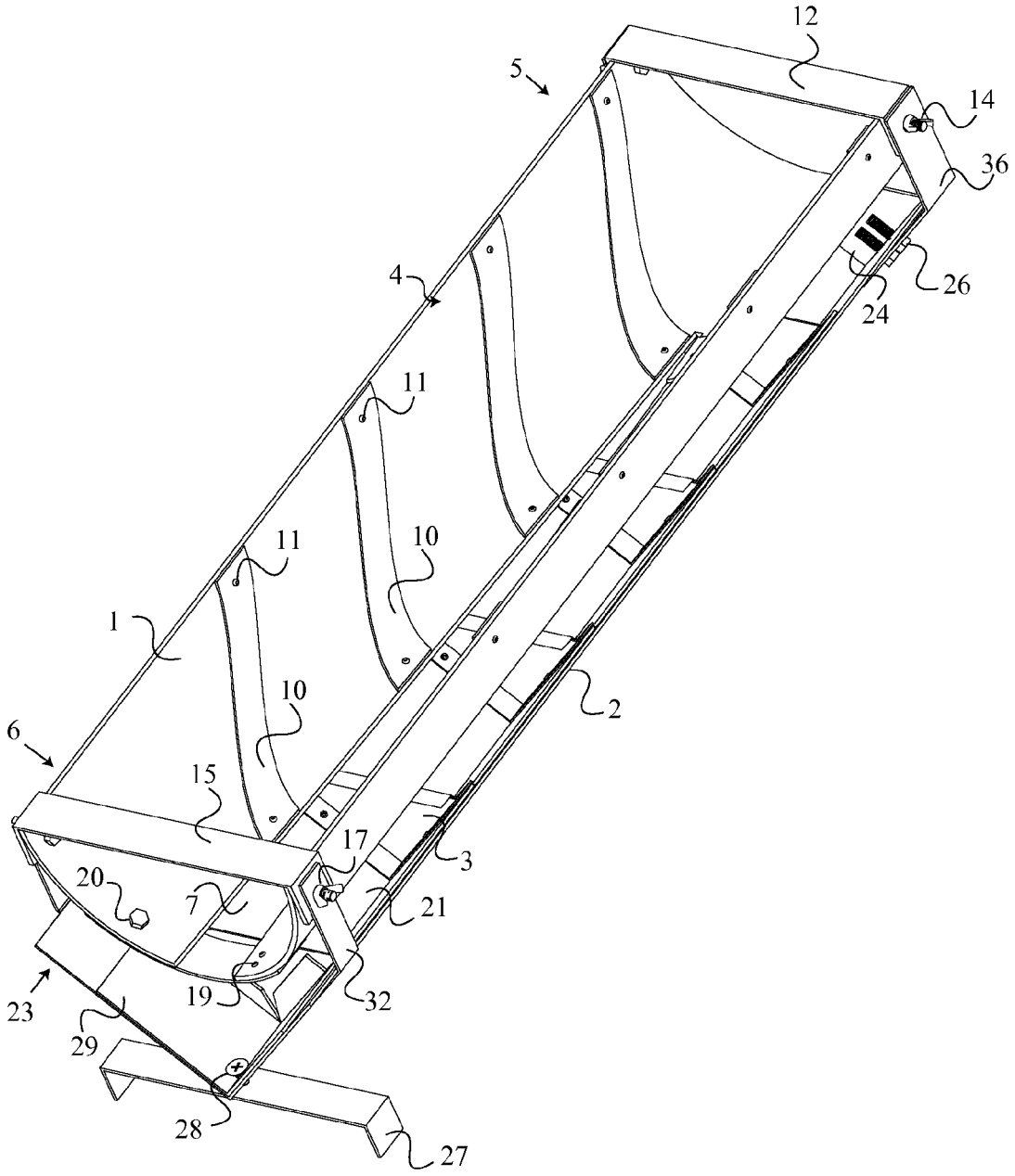
FIG. 3 is a right perspective view of the present invention when the invention is closed.
Figure 4:
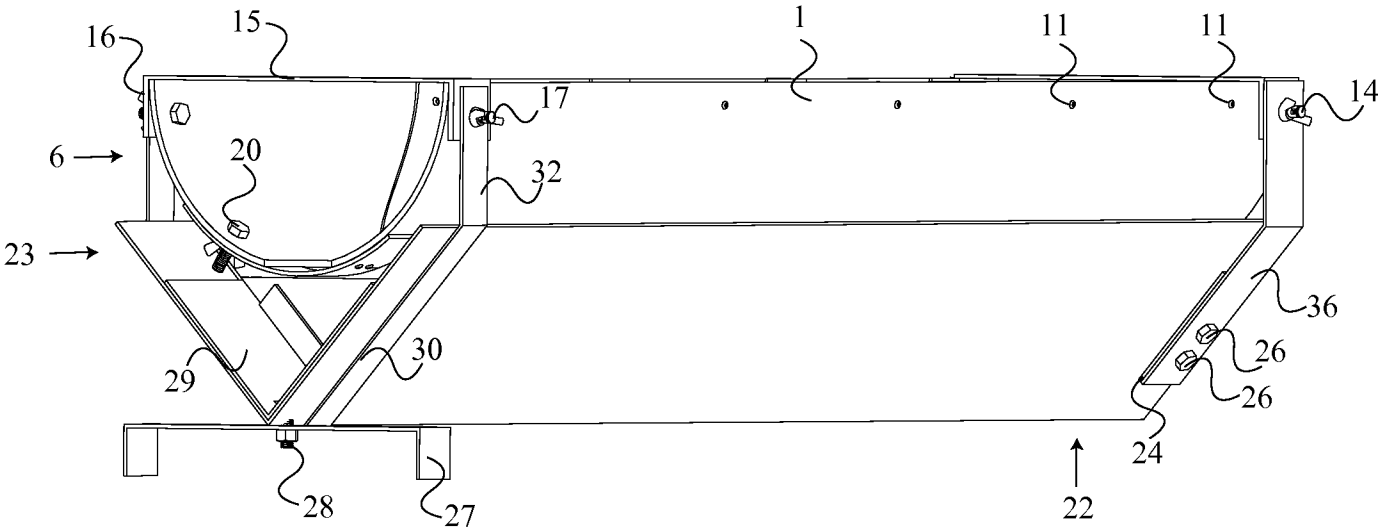
FIG. 4 is a bottom right perspective view of the present invention when the invention is closed.
Figure 5:
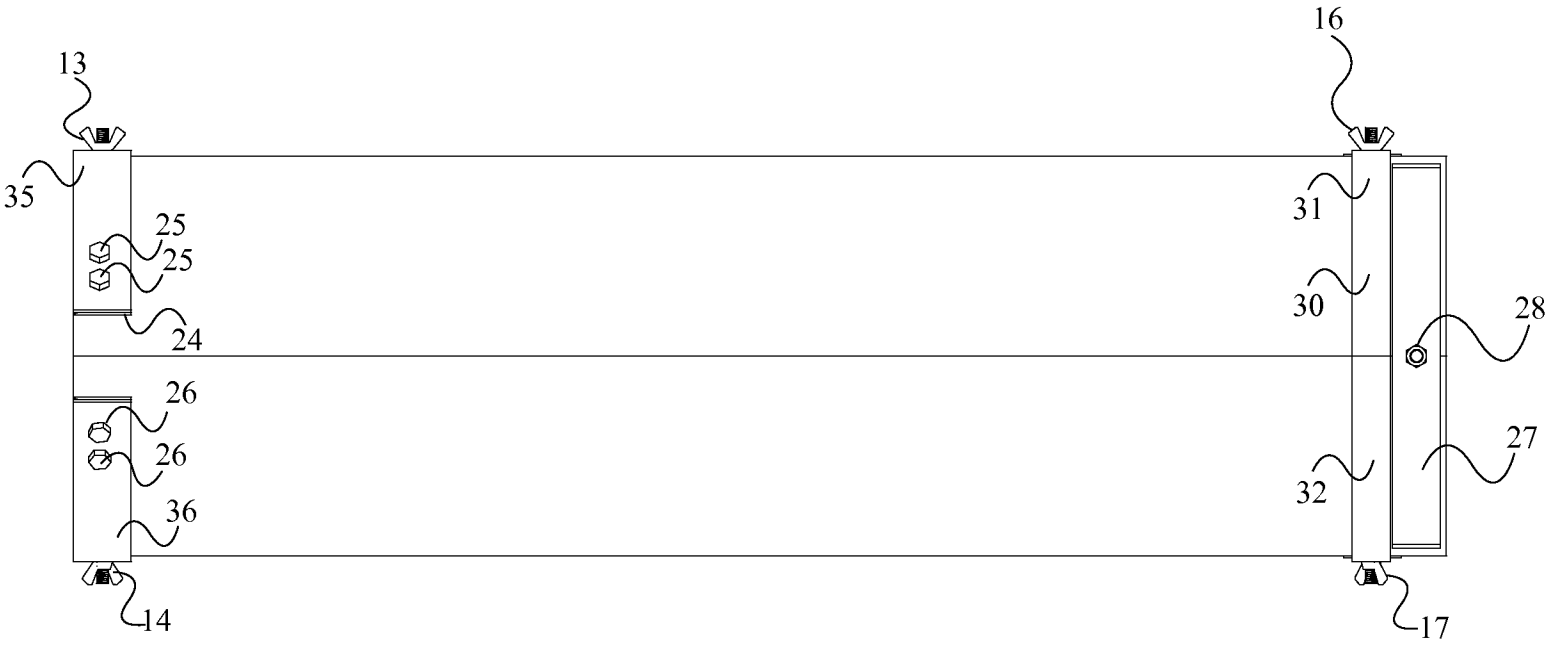
FIG. 5 is a bottom view of the present invention when the invention is closed.
Figure 6:
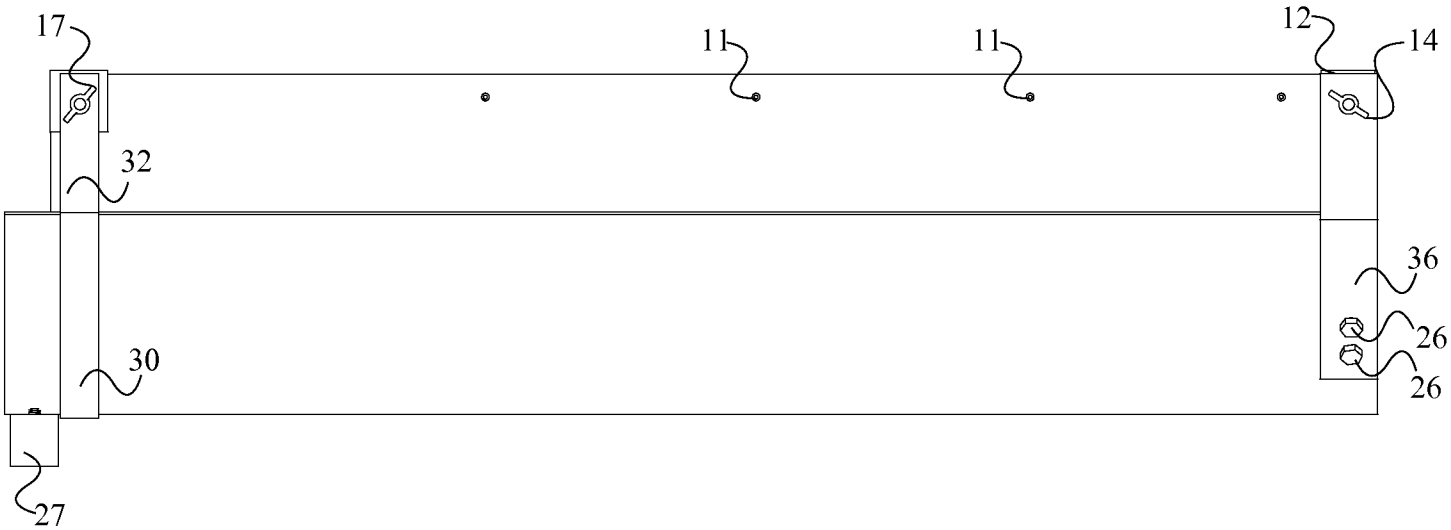
FIG. 6 is a right view of the present invention when the invention is closed.
Figure 7:
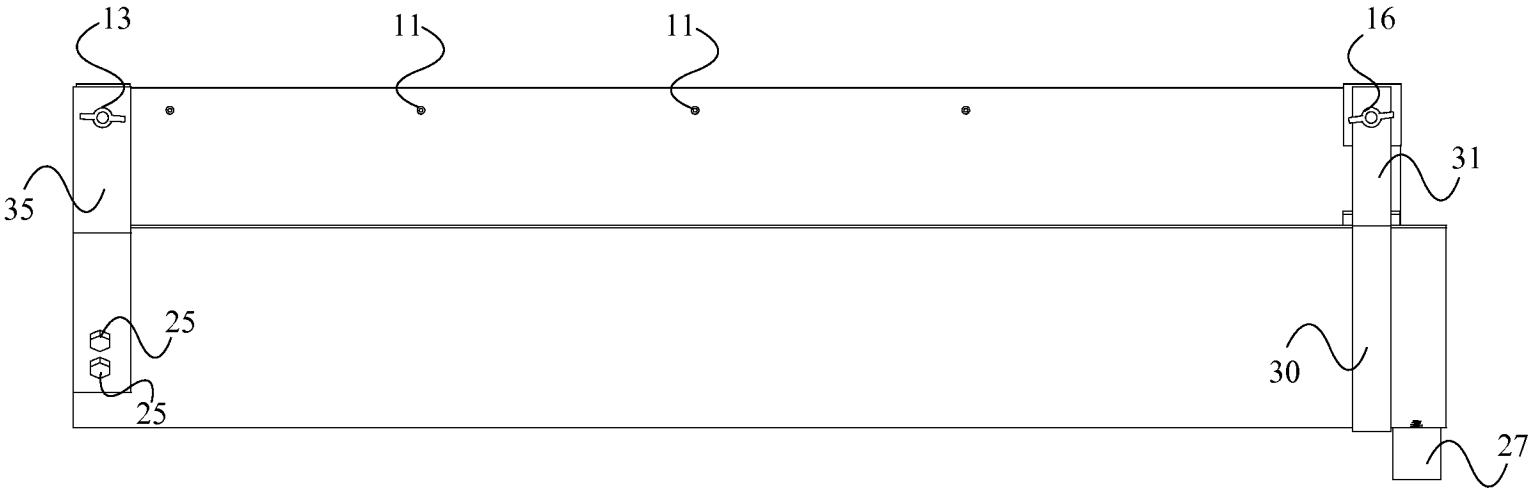
FIG. 7 is a left view of the present invention when the invention is closed.
Figure 8:
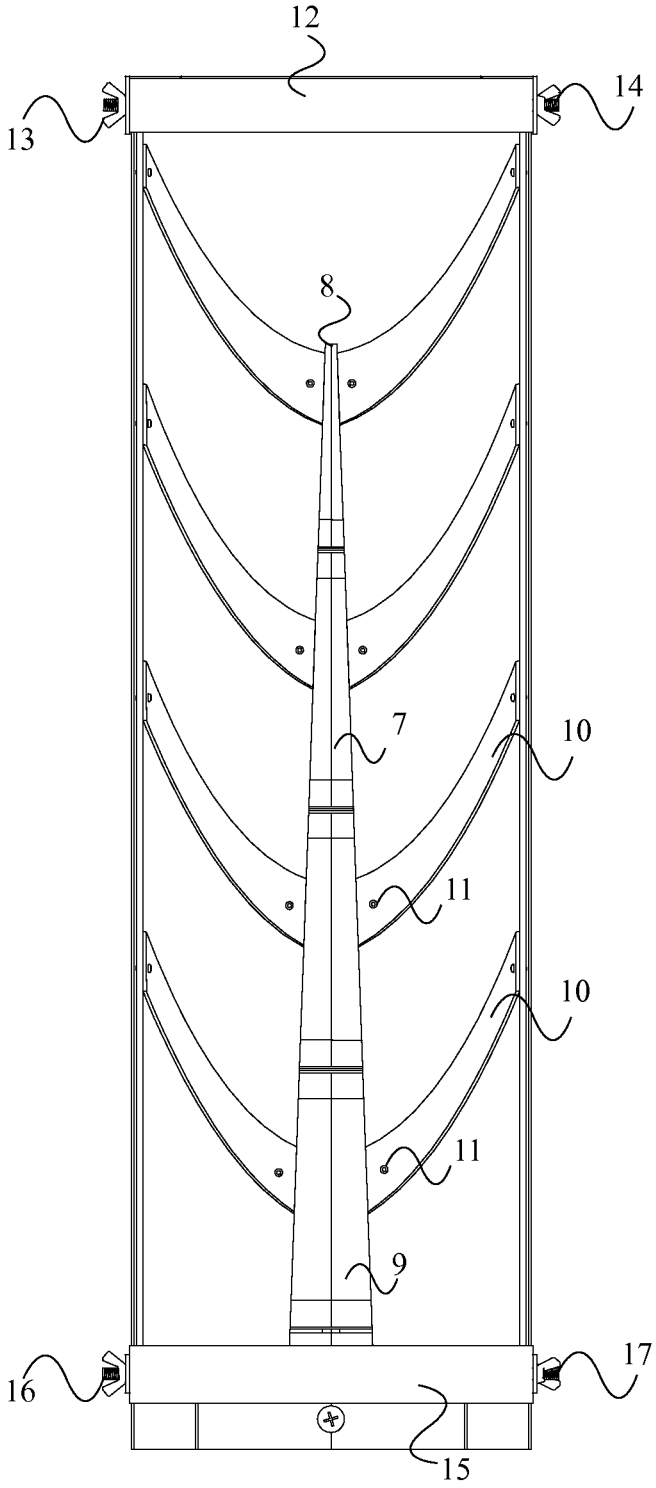
FIG. 8 is a top view of the present invention when the invention is closed.
Figure 9:
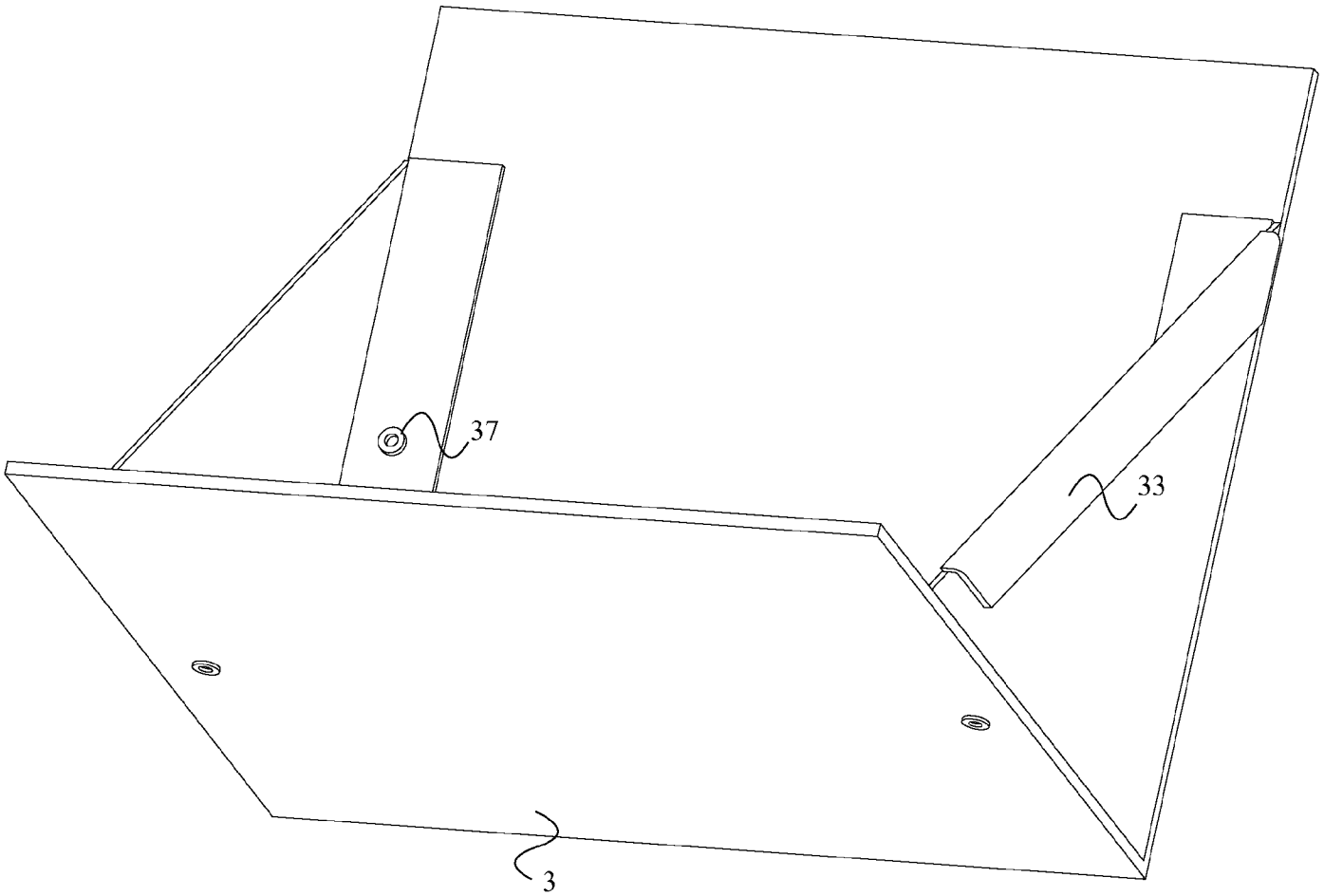
FIG. 9 is a view of a small trough showing a female connector.
Figure 10:
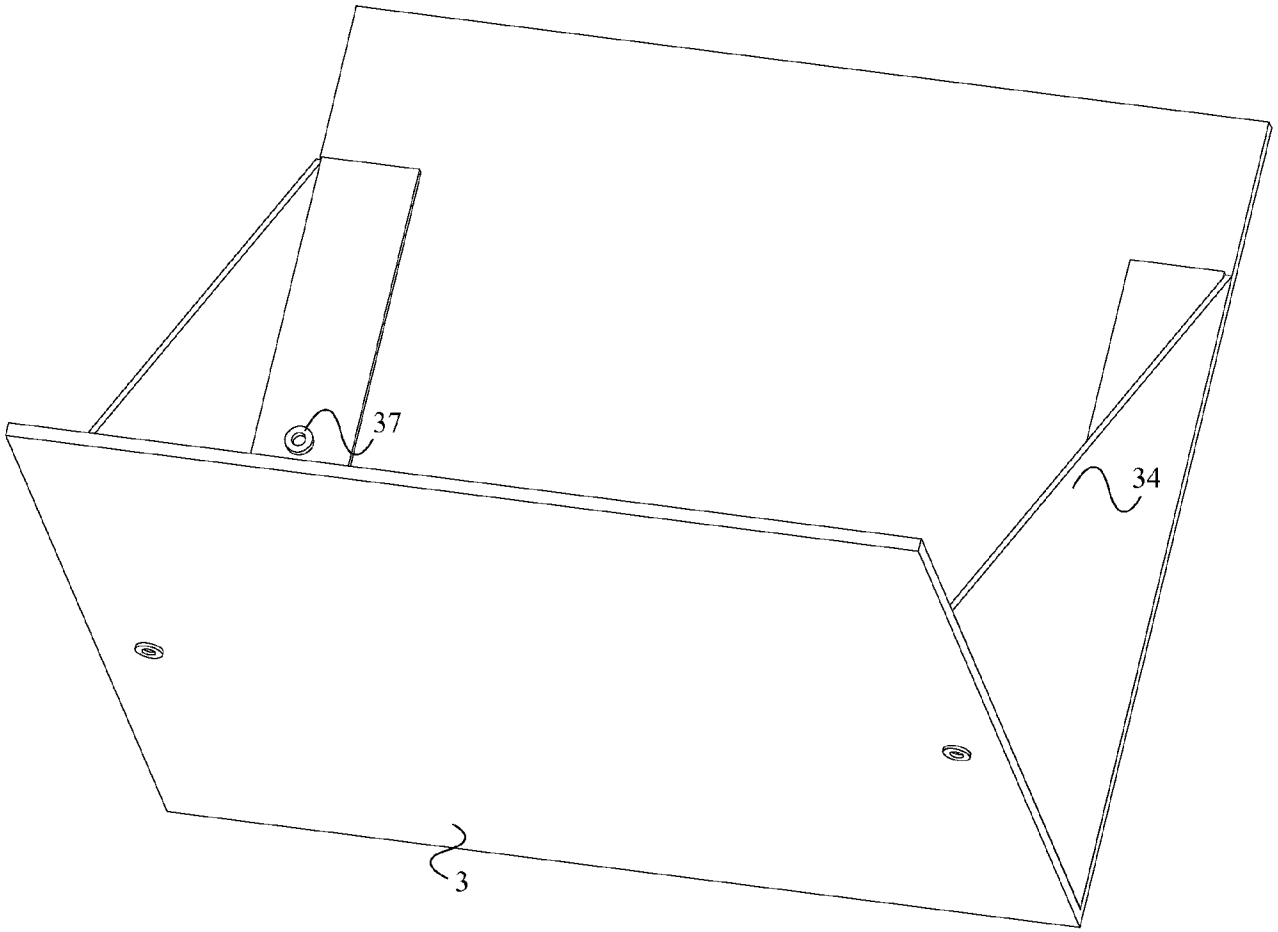
FIG. 10 is a view of a small trough showing a male connector.
Figure 11:
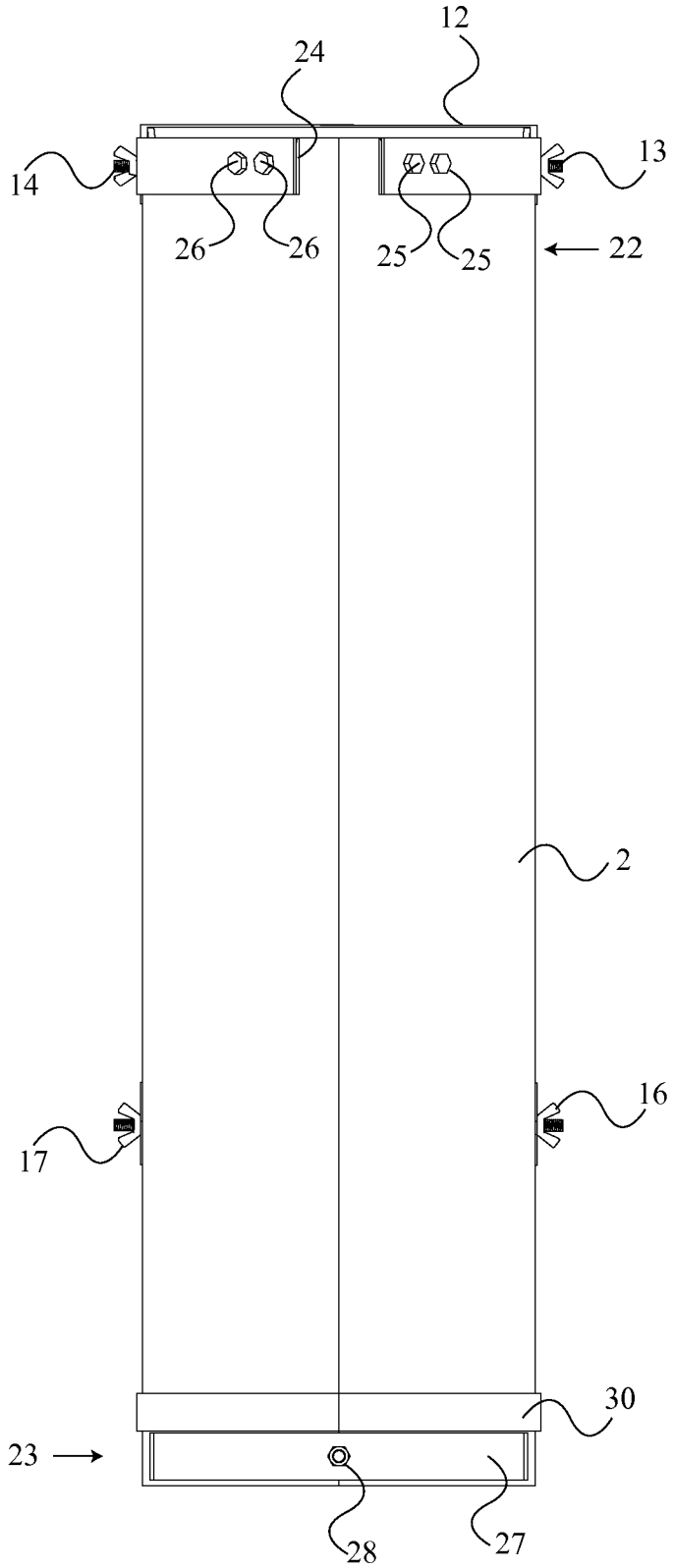
FIG. 11 is a bottom view of the present invention when the invention is open.
Figure 12:
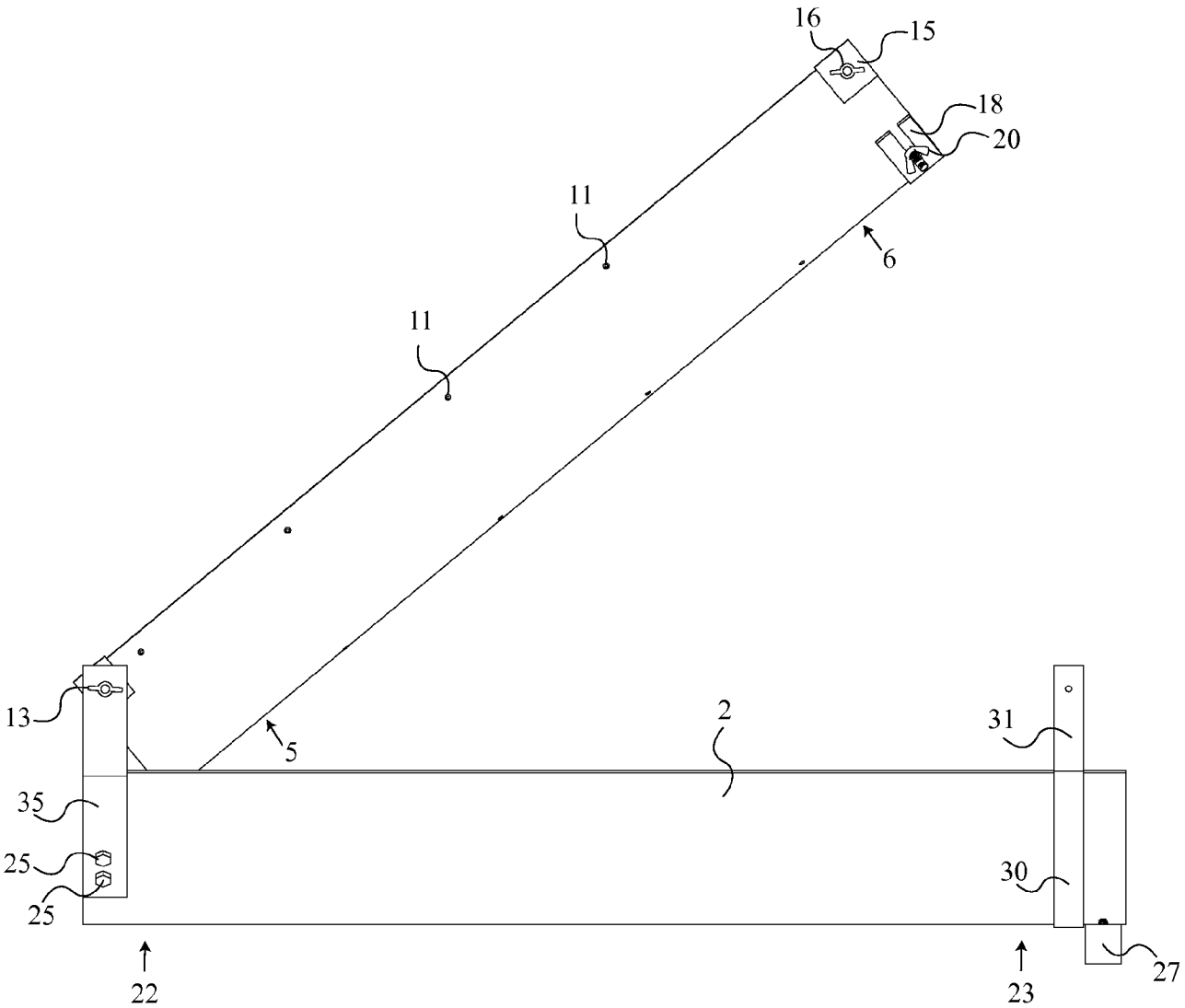
FIG. 12 is a left view of the present invention when the invention is open.

The plurality of small troughs 3 is situated adjacent to each other, in a linear fashion, along and beneath the slit 7. As can be seen in FIG. 20, FIG. 9 and FIG. 10, the plurality of the small troughs connects to each other via a female end 33 and a male end 34. The female end 33 is attached to the male end 34 via a hook mechanism. Additionally, the female end 33 of each of the plurality of small troughs 3 is a flange that overarches the male end 34 of each of the plurality of small troughs. The male end 34 of each of the plurality of small troughs 3 is a bare side of each of the plurality of small troughs 3. The bare side of each of the plurality of small troughs 3 does not comprise a flange that overarches. The female end 33 is positioned opposite to the male end 34 on each of the plurality of small troughs. The plurality of small troughs 3 also comprises a plurality of small trough rivets 37. The plurality of small trough rivets 37 holds the plurality of small troughs 3 together. The plurality of small trough rivets 37 connects all components that make up each of the plurality of small troughs 3. In the preferred embodiment, the plurality of small troughs 3 together forms a 2 foot long classifier below the PVC channel 1. The narrow end 8 of the slit 7 is above a top end of the plurality of small troughs 3, whereas the wide end 9 of the slit 7 is covered by the slit connector 18. The top end of the plurality of small troughs 3 has been designed and located in a such a manner that the top end of the plurality of small troughs 3 catches all the smallest and densest particles that fall in the narrow end 8 of the slit 7. There is an empty slit space starting from the slit connector 18 to the narrow end 8. Situated directly beneath the empty slit space next to the slit connector 18 is a bottom end of the plurality of small troughs 3. As can be seen in FIG. 2, the bottom end of the plurality of small troughs 3 is adjacent to a stopper V flange 29. The stopper V flange 29 is attached to the trough inside 21 via a center fastener 28, near the bottom trough end 23, to keep the plurality of small troughs 3 in place and to prevent the plurality of small troughs 3 from sliding vertically down the main trough 2.

Figure 18:
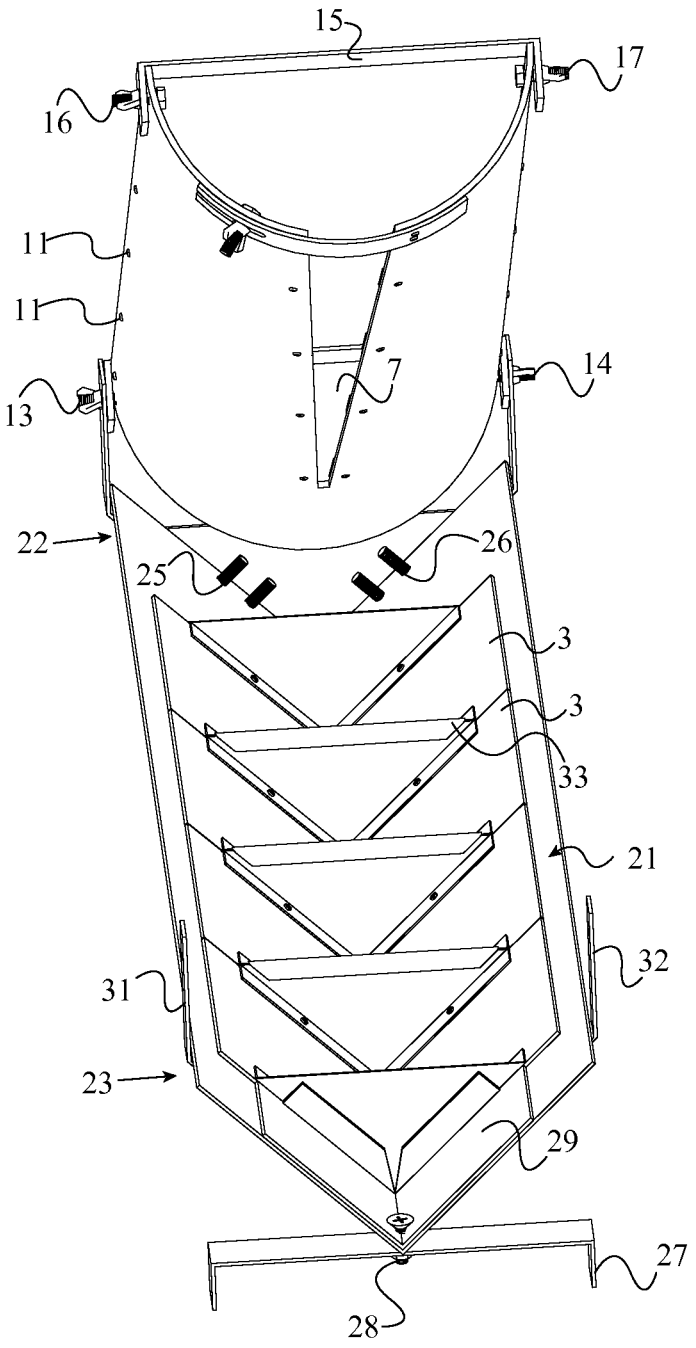
FIG. 18 is a top perspective view of the present invention when the invention is open.
Figure 19:
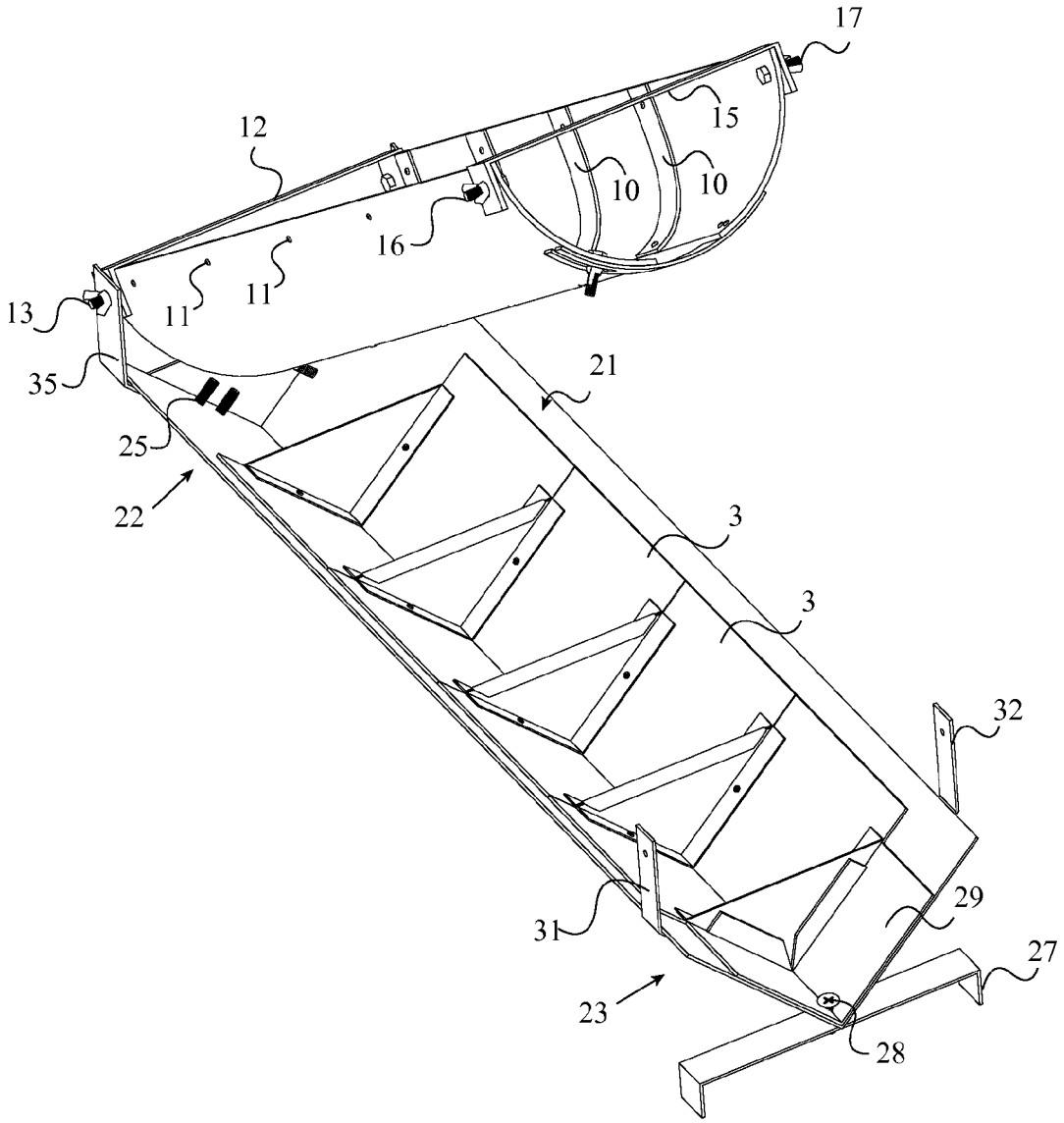
FIG. 19 is a top left perspective view of the present invention when the invention is open.

As can be seen in FIG. 2, attached beneath the bottom trough end 23, on an opposite side of the stopper V flange 29, is a stand bracket 27. The stand bracket 27 is fastened to the bottom trough end 23 by the center fastener 28. The stand bracket 27 helps support the bottom trough end 23 and the bottom PVC end 6 during use. The stand bracket 27 also helps support the particle classifier apparatus in its upright position. As can be seen in FIG. 15 and FIG. 18, a triangular top flange 24 is attached to the top trough end 22 by a plurality of left top bolts 25 and a plurality of right top bolts 26. The plurality of left top bolts 25 and the plurality of right top bolts 26 not only attach the triangular top flange 24 to the top trough end 22, but the plurality of left top bolts 25 and the plurality of right top bolts 26 also attach the top left connector 35 and the top right connector 36 to the PVC channel 1 and the main trough 2. Without the plurality of left top bolts 25 and the plurality of right top bolts 26, the top left connector 35 and the top right connector 36 cannot be supported. Therefore, the top PVC end 5 cannot be supported without the plurality of left top bolts 25 and the plurality of right top bolts 26. The triangular top flange 24 prevents outside particles from interfering with the classifying process of the present invention. Without the triangular top flange 24, outside particles could fall into the top end of the main trough 2 and accumulate, weighing down the present invention.

To use the present invention, the user arrives at a desired location where s/he must carry the apparatus with the top bracket 12 and the bottom bracket 15, and slide the top PVC end 5 and top trough end 22 into a stream bed with the direction of water stream flowing vertically down the apparatus from the top PVC end 5 to the bottom PVC end 6. Then, the trough connector 30 is unfastened, releasing the bottom PVC end 6 from the bottom trough end 23. The bottom PVC end 6 is thus lifted up slightly to slow down the flow of water. The user may also place more particles into the classifier near the top PVC end 5 and the narrow end 8 of the slit 7 to be classified. When the plurality of small troughs 3 beneath the slit 7 is full of particles, each of the plurality of small troughs 3 can be removed individually or together at the same time. The collected particles can be further classified in a gold pan. The present invention may be used without a stream of flowing water. The user would need to position the present invention in a manner where the top trough end 22 and the top PVC end 5 are slightly elevated above the bottom trough end 23 and the bottom PVC end 6. With the present invention tilted, the user would place the dry particles at the top PVC end 5 while allowing the dry particles to be mixed with a bucket of water and washed down and into the slit 7. The bucket of water is used to flush the dry particles into the slit 7. The water should be able to flow down out of the bottom trough end 23 and into the ground due to the gravity of the Earth.

Although the invention has been explained in relation to its preferred embodiment, it is to be understood that many other possible modifications and variations can be made without departing from the spirit and scope of the invention as hereinafter claimed.

What is claimed is:

1. A particle classifier apparatus comprises:

a PVC channel;

a main trough;

a plurality of small troughs;

the PVC channel comprises a PVC inside, a top PVC end, a bottom PVC end, a slit, a plurality of curved bars, a top bracket, a top left connector, a top right connector, a bottom bracket, and a slit connector;

the slit comprises a narrow end and a wide end;

each curved bar comprises a plurality of flat bolts;

the top bracket comprises a top left fastener and a top right fastener;

the bottom bracket comprises a bottom left fastener and a bottom right fastener;

the slit connector comprises a plurality of connector flat bolts and a connector fastener;

the main trough comprises a trough inside, a top trough end, a bottom trough end, a triangular top flange, a stand bracket, a stopper V flange, and a trough connector;

the trough connector comprises a left trough connector and a right trough connector;

the triangular top flange comprises a plurality of left top bolts and a plurality of right top bolts;

the stand bracket comprises a center fastener;

each small trough of the plurality of small troughs comprises a female end and a male end;

the plurality of small troughs comprises a plurality of small trough rivets;

the plurality of small troughs being situated on the trough inside;

the PVC channel being fastened to the main trough;

the PVC top end being rotatably attached to the top trough end; and the slit being situated on the PVC inside.

2. The particle classifier apparatus as claimed in claim 1 comprises, the plurality of small troughs being situated adjacent to each other;

the plurality of small troughs being linearly distributed along the trough inside;

the plurality of small troughs being situated adjacent to the stopper V flange; and the plurality of small troughs being attached to one another via connecting female ends of small troughs to male ends of other small troughs.

3. The particle classifier apparatus as claimed in claim 1 comprises, the PVC channel being situated atop of the plurality of small troughs;

the top PVC end being situated above the top trough end;

the bottom PVC end being situated above the bottom trough end;

the top PVC end being fastened to the top trough end by the top bracket;

the top PVC end being fastened to the top trough end by the top left connector and the top right connector;

the bottom bracket being attached to the bottom PVC end;

the bottom PVC end being fastened to the bottom trough end by the left trough connector and the right trough connector; and the PVC channel having the plurality of curved bars attached to the PVC inside.

4. The particle classifier apparatus as claimed in claim 3 comprises, the top bracket being fastened to the top PVC end and the top trough end by the top left fastener;

the top bracket being fastened to the top PVC end and the top trough end by the top right fastener;

the bottom bracket being fastened to the bottom PVC end and the bottom trough end by the bottom left fastener;

the bottom bracket being fastened to the bottom PVC end and the bottom trough end by the bottom right fastener;

the left trough connector being attached to the bottom PVC end, the bottom bracket and the main trough;

the right trough connector being attached to the bottom PVC end, the bottom bracket and the main trough; and the bottom PVC end and the bottom bracket being detached from the left trough connector and the right trough connector by loosening the bottom left fastener and the bottom right fastener, respectively.

5. The particle classifier apparatus as claimed in claim 3 comprises, the plurality of curved bars being fastened to the PVC inside by the plurality of flat bolts;

the plurality of curved bars being situated adjacent to the slit;

the plurality of curved bars being positioned opposite to each other alongside the slit; and the plurality of curved bars being separated from each other by a distance.

6. The particle classifier apparatus as claimed in claim 1 comprises, the narrow end of the slit being positioned adjacent to the top PVC end;

the wide end of the slit being positioned at the bottom PVC end;

the wide end of the slit situated under the bottom bracket;

the wide end of the slit situated directly above the stand bracket;

the wide end of the slit is fastened to by the slit connector;

the slit connector being fastened to the wide end by the plurality of connector flat bolts at one end; and the slit connector being fastened to the wide end by the connector fastener.

7. The particle classifier apparatus as claimed in claim 1 comprises, the triangular top flange being attached to the top trough end;

the triangular top flange being attached to the top trough end by the plurality of left top bolts;

the triangular top flange being attached to the top trough end by the plurality of right top bolts;

the stopper V flange being attached to the bottom trough end via the center fastener;

the stand bracket being attached to the bottom trough end ; and the stand bracket being fastened to the main trough by the center fastener.

8. A particle classifier apparatus comprises:

a PVC channel;

a main trough;

a plurality of small troughs;

the PVC channel comprises a PVC inside, a top PVC end, a bottom PVC end, a slit, a plurality of curved bars, a top bracket, a top left connector, a top right connector, a bottom bracket, and a slit connector;

the slit comprises a narrow end and a wide end;

each curved bar comprises a plurality of flat bolts;

the top bracket comprises a top left fastener and a top right fastener;

the bottom bracket comprises a bottom left fastener and a bottom right fastener;

the slit connector comprises a plurality of connector flat bolts and a connector fastener;

the main trough comprises a trough inside, a top trough end, a bottom trough end, a triangular top flange, a stand bracket, a stopper V flange, and a trough connector;

the trough connector comprises a left trough connector and a right trough connector;

the triangular top flange comprises a plurality of left top bolts and a plurality of right top bolts;

the stand bracket comprises a center fastener;

each small trough of the plurality of small troughs comprises a female end and a male end;

the plurality of small troughs comprises a plurality of small trough rivets;

the plurality of small troughs being situated on the trough inside;

the PVC channel being fastened to the main trough;

the PVC top end being rotatably attached to the top trough end;

the slit being situated on the PVC inside;

the PVC channel being situated atop of the plurality of small troughs;

the top PVC end being situated above the top trough end;

the bottom PVC end being situated above the bottom trough end;

the top PVC end being fastened to the top trough end by the top bracket;

the top PVC end being fastened to the top trough end by the top left connector and the top right connector;

the bottom bracket being attached to the bottom PVC end;

the bottom PVC end being fastened to the bottom trough end by the left trough connector and the right trough connector; and the PVC channel having the plurality of curved bars attached to the PVC inside.

9. The particle classifier apparatus as claimed in claim 8 comprises, the plurality of small troughs being situated adjacent to each other;

the plurality of small troughs being linearly distributed along the trough inside;

the plurality of small troughs being situated adjacent to the stopper V flange; and the plurality of small troughs being attached to one another via connecting female ends of small troughs to male ends of other small troughs.

10. The particle classifier apparatus as claimed in claim 8 comprises, the top bracket being fastened to the top PVC end and the top trough end by the top left fastener;

the top bracket being fastened to the top PVC end and the top trough end by the top right fastener;

the bottom bracket being fastened to the bottom PVC end and the bottom trough end by the bottom left fastener;

the bottom bracket being fastened to the bottom PVC end and the bottom trough end by the bottom right fastener;

the left trough connector being attached to the bottom PVC end, the bottom bracket and the main trough;

the right trough connector being attached to the bottom PVC end, the bottom bracket and the main trough;

the plurality of curved bars being fastened to the PVC inside by the plurality of flat bolts;

the plurality of curved bars being situated adjacent to the slit;

the plurality of curved bars being positioned opposite to each other alongside the slit; and the plurality of curved bars being separated from each other by a distance.

11. The particle classifier apparatus as claimed in claim 8 comprises, the narrow end of the slit being positioned adjacent to the top PVC end;

the wide end of the slit being positioned at the bottom PVC end;

the wide end of the slit situated under the bottom bracket;

the wide end of the slit situated directly above the stand bracket;

the wide end of the slit is fastened to by the slit connector;

the slit connector being fastened to the wide end by the plurality of connector flat bolts at one end; and the slit connector being fastened to the wide end by the connector fastener.

12. The particle classifier apparatus as claimed in claim 8 comprises, the triangular top flange being attached to the top trough end;

the triangular top flange being attached to the top trough end by the plurality of left top bolts;

the triangular top flange being attached to the top trough end by the plurality of right top bolts;

the stopper V flange being attached to the bottom trough end via the center fastener;

the stand bracket being attached to the bottom trough end; and the stand bracket being fastened to the main trough by the center fastener.

13. A particle classifier apparatus comprises:

a PVC channel;

a main trough;

a plurality of small troughs;

the PVC channel comprises a PVC inside, a top PVC end, a bottom PVC end, a slit, a plurality of curved bars, a top bracket, a top left connector, a top right connector, a bottom bracket, and a slit connector;

the slit comprises a narrow end and a wide end;

each curved bar comprises a plurality of flat bolts;

the top bracket comprises a top left fastener and a top right fastener;

the bottom bracket comprises a bottom left fastener and a bottom right fastener;

the slit connector comprises a plurality of connector flat bolts and a connector fastener;

the main trough comprises a trough inside, a top trough end, a bottom trough end, a triangular top flange, a stand bracket, a stopper V flange, and a trough connector;

the trough connector comprises a left trough connector and a right trough connector;

the triangular top flange comprises a plurality of left top bolts and a plurality of right top bolts;

the stand bracket comprises a center fastener;

each small trough of the plurality of small troughs comprises a female end and a male end;

the plurality of small troughs comprises a plurality of small trough rivets;

the plurality of small troughs being situated on the trough inside;

the PVC channel being fastened to the main trough;

the PVC top end being rotatably attached to the top trough end;

the slit being situated on the PVC inside;

the PVC channel being situated atop of the plurality of small troughs;

the top PVC end being situated above the top trough end;

the bottom PVC end being situated above the bottom trough end;

the top PVC end being fastened to the top trough end by the top bracket;

the top PVC end being fastened to the top trough end by the top left connector and the top right connector;

the bottom bracket being attached to the bottom PVC end;

the bottom PVC end being fastened to the bottom trough end by the left trough connector and the right trough connector;

the PVC channel having the plurality of curved bars attached to the PVC inside;

the narrow end of the slit being positioned adjacent to the top PVC end; and the wide end of the slit being positioned at the bottom PVC end.

14. The particle classifier apparatus as claimed in claim 13 comprises, the plurality of small troughs being situated adjacent to each other;

the plurality of small troughs being linearly distributed along the trough inside;

the plurality of small troughs being situated adjacent to the stopper V flange; and the plurality of small troughs being attached to one another via connecting female ends of small troughs to male ends of other small troughs.

15. The particle classifier apparatus as claimed in claim 13 comprises, the top bracket being fastened to the top PVC end and the top trough end by the top left fastener;

the top bracket being fastened to the top PVC end and the top trough end by the top right fastener;

the bottom bracket being fastened to the bottom PVC end and the bottom trough end by the bottom left fastener;

the bottom bracket being fastened to the bottom PVC end and the bottom trough end by the bottom right fastener;

the left trough connector being attached to the bottom PVC end, the bottom bracket and the main trough;

the right trough connector being attached to the bottom PVC end, the bottom bracket and the main trough;

the bottom PVC end and the bottom bracket being detached from the left trough connector and the right trough connector by loosening the bottom left fastener and the bottom right fastener, respectively;

the plurality of curved bars being fastened to the PVC inside by the plurality of flat bolts;

the plurality of curved bars being situated adjacent to the slit;

the plurality of curved bars being positioned opposite to each other alongside the slit; and the plurality of curved bars being separated from each other by a distance.

16. The particle classifier apparatus as claimed in claim 13 comprises, the wide end of the slit situated under the bottom bracket;

the wide end of the slit situated directly above the stand bracket;

the wide end of the slit is fastened to by the slit connector;

the slit connector being fastened to the wide end by the plurality of connector flat bolts at one end; and the slit connector being fastened to the wide end by the connector fastener.

17. The particle classifier apparatus as claimed in claim 13 comprises, the triangular top flange being attached to the top trough end;

the triangular top flange being attached to the top trough end by the plurality of left top bolts;

the triangular top flange being attached to the top trough end by the plurality of right top bolts;

the stopper V flange being attached to the bottom trough end via the center fastener;

the stand bracket being attached to the bottom trough end; and the stand bracket being fastened to the main trough by the center fastener.

* * * * *